US009316193B2

(12) United States Patent
Yabuuchi

(10) Patent No.: US 9,316,193 B2
(45) Date of Patent: Apr. 19, 2016

(54) HIGH-PRESSURE PUMP

(75) Inventor: Takeyuki Yabuuchi, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 242 days.

(21) Appl. No.: 13/976,726

(22) PCT Filed: Dec. 28, 2010

(86) PCT No.: PCT/JP2010/073764

§ 371 (c)(1),
(2), (4) Date: Jun. 27, 2013

(87) PCT Pub. No.: WO2012/090318

PCT Pub. Date: Jul. 5, 2012

(65) Prior Publication Data

US 2013/0269656 A1 Oct. 17, 2013

(51) Int. Cl.

| | |
|---|---|
| ***F01L 1/18*** | (2006.01) |
| ***F02M 57/02*** | (2006.01) |
| ***F02M 39/02*** | (2006.01) |
| ***F02M 59/10*** | (2006.01) |
| *F01L 3/00* | (2006.01) |

(52) U.S. Cl.

CPC ..... *F02M 57/023* (2013.01); *F02M 39/02* (2013.01); *F02M 59/102* (2013.01); *F01L 1/185* (2013.01); *F01L 2001/187* (2013.01); *F01L 2003/25* (2013.01); *F01L 2105/00* (2013.01)

(58) Field of Classification Search

CPC ..... F01L 2001/187

See application file for complete search history.

(56) References Cited

U.S. PATENT DOCUMENTS

| | | | | |
|---|---|---|---|---|
| 5,899,383 | A | 5/1999 | Hickey et al. | |
| 2009/0145388 | A1 * | 6/2009 | Hiramatsu | 123/90.39 |
| 2011/0000451 | A1 * | 1/2011 | Kraus | 123/90.46 |

FOREIGN PATENT DOCUMENTS

| | | | |
|---|---|---|---|
| JP | 2004-218479 | A | 8/2004 |
| JP | 2004-308615 | A | 11/2004 |

* cited by examiner

*Primary Examiner* — F. Daniel Lopez

(74) *Attorney, Agent, or Firm* — Sughrue Mion, PLLC

(57) ABSTRACT

Disclosed is a high-pressure pump which can easily be installed in an internal-combustion engine. Specifically disclosed is a high-pressure pump 1 provided with a mounting member 100. The mounting member 100 is fixed to a pivot 70 so as to keep such an attitude of a rocker arm 60 that the protruding end part of the pivot 70 is positioned within a concave 65*a* formed on a second end 65 of the rocker arm 60 and that the outer circumferential surface of the protruding end part of the pivot 70 is apart from the inner circumferential surface of the concave 65*a* by coming in contact with an arm body 62 of the rocker arm 60 to resist a turn of the rocker arm 60 around a roller 61 under the weight thereof, before a plunger 50 is brought into contact with a first end 64 of the rocker arm 60, and so as to come out of contact with the arm body 62 when the rocker arm 60 turns in reverse to the turn under the weight thereof, after the plunger 50 is brought into contact with the first end 64.

2 Claims, 7 Drawing Sheets

HIGH-PRESSURE PUMP

CROSS REFERENCE TO RELATED APPLICATIONS

This application is a National Stage of International Application No. PCT/JP2010/073764, filed on Dec. 28, 2010, the contents of all of which are incorporated herein by reference in their entirety.

TECHNICAL FIELD

The present invention relates to a high-pressure pump used for an internal-combustion engine of a direct-injection type, and the like, especially to a technique of mounting a rocker arm reciprocating a plunger in association with a rotation of a cam.

BACKGROUND ART

Conventionally, a high-pressure pump is widely known that is used for an internal-combustion engine of a direct-injection type, and the like, and that pumps fuel to fuel-injection valves. For example, Patent Literature 1 discloses a high-pressure pump which includes a rocker arm rocking in association with a rotation of a cam of the internal-combustion engine, a pivot supporting the rocker arm in a rockable manner, and a plunger reciprocating in association with a movement of the rocker arm.

The rocker arm provided in the high-pressure pump as mentioned above includes a roller rotating on the axis thereof parallel to a cam shaft of the internal-combustion engine. The rocker arm has a first end protruding from the part thereof to which the roller is attached, and a second end protruding from the part thereof to which the roller is attached in a direction opposite to the first end. The rocker arm is provided on the top of the cam of the internal-combustion engine so that the roller comes in contact with the outer circumferential surface of the cam in a state where the pivot is arranged in a semispherical recess formed on the top surface of the second end, and where the plunger comes in contact with the top surface of the first end.

The rocker arm configured in this manner is mounted as follows.

First, the rocker arm is arranged on the top of the cam of the internal-combustion engine so that the roller of the rocker arm comes in contact with the outer circumferential surface of the cam, and the pivot is arranged in the recess of the second end of the rocker arm.

Then, the plunger is brought into contact with the first end of the rocker arm.

When the rocker arm is provided on the top of the cam of the internal-combustion engine as mentioned above, the rocker arm tilts around the roller under the weight thereof so that the second end moves downward, and finally may fall down from the cam.

Consequently, when, for example, the high-pressure pump is installed in the internal-combustion engine in a manufacturing line, or the high-pressure pump is replaced, these operations are complicated.

CITATION LIST

Patent Literature

Patent Literature 1: JP 2004-218479 A

SUMMARY OF INVENTION

Problem to be Solved by the Invention

The objective of the present invention is to provide a high-pressure pump which can easily be installed in an internal-combustion engine.

Means for Solving the Problem

A first aspect of the invention is a high-pressure pump to be installed in an internal-combustion engine having a cam shaft, which includes a rocker arm which is mounted on a cam provided on the cam shaft of the internal-combustion engine, and which rocks in association with a rotation of the cam, a pivot which protrudes downward, and the protruding end part of which supports the rocker arm in a rockable manner, a plunger which reciprocates in a top-bottom direction in association with a movement of the rocker arm, and a mounting member. The rocker arm includes a roller which rotates on an axis parallel to the cam shaft, and which rolls on the outer circumferential surface of the cam, and an arm body which supports the roller in a rotatable manner. The arm body includes a roller-attached part to which the roller is attached, a first end which protrudes from the roller-attached part in a direction perpendicular to the axis of the roller, and which comes in contact with the bottom end part of the plunger from below, and a second end which protrudes from the roller-attached part in a direction opposite to the first end, and which comes in contact with the protruding end part of the pivot from below. The second end has a concave which is recessed downward, and in which the pivot is provided. The mounting member is fixed at a predetermined position so as to keep such an attitude of the rocker arm that the protruding end part of the pivot is positioned within the concave of the second end and that the outer circumferential surface of the protruding end part of the pivot is apart from the inner circumferential surface of the concave by coming in contact with the arm body to resist a turn of the rocker arm around the roller under the weight of the rocker arm, before the plunger is brought into contact with the first end, and so as to come out of contact with the arm body when the rocker arm turns in reverse to the turn under the weight of the rocker arm, after the plunger is brought into contact with the first end.

Preferably, the mounting member includes a pair of anti-turning parts which protrudes toward the arm body, in which the pair of anti-turning parts holds both end parts of the arm body in an axial direction of the roller between the pair of anti-turning parts when the arm body comes in contact with the mounting member, and is formed to gradually increase in distance therebetween in a direction in which the pair of anti-turning parts protrudes.

Advantageously, the mounting member includes a pair of anti-turning parts which protrudes toward the arm body, in which the pair of anti-turning parts has a pair of vertical parts which holds both end parts of the arm body in an axial direction of the roller between the pair of vertical parts when the arm body comes in contact with the mounting member, and which is formed parallel to each other with a constant distance therebetween, and a pair of inclined parts in which each inclined part is continuous with a corresponding one of the pair of vertical parts, and which is formed to gradually increase in distance therebetween in a direction away from the pair of vertical parts.

Effects of the Invention

According to the present invention, a high-pressure pump can easily be installed in an internal-combustion engine.

DESCRIPTION OF EMBODIMENTS

First Embodiment

With reference to FIGS. 1 to 8, described below is a high-pressure pump 1 as a first embodiment of a high-pressure pump according to the present invention.

The high-pressure pump 1 is installed in an internal-combustion engine of a direct-injection type, and pumps fuel to fuel-injection valves (not shown) of the internal-combustion engine.

Figure 1:
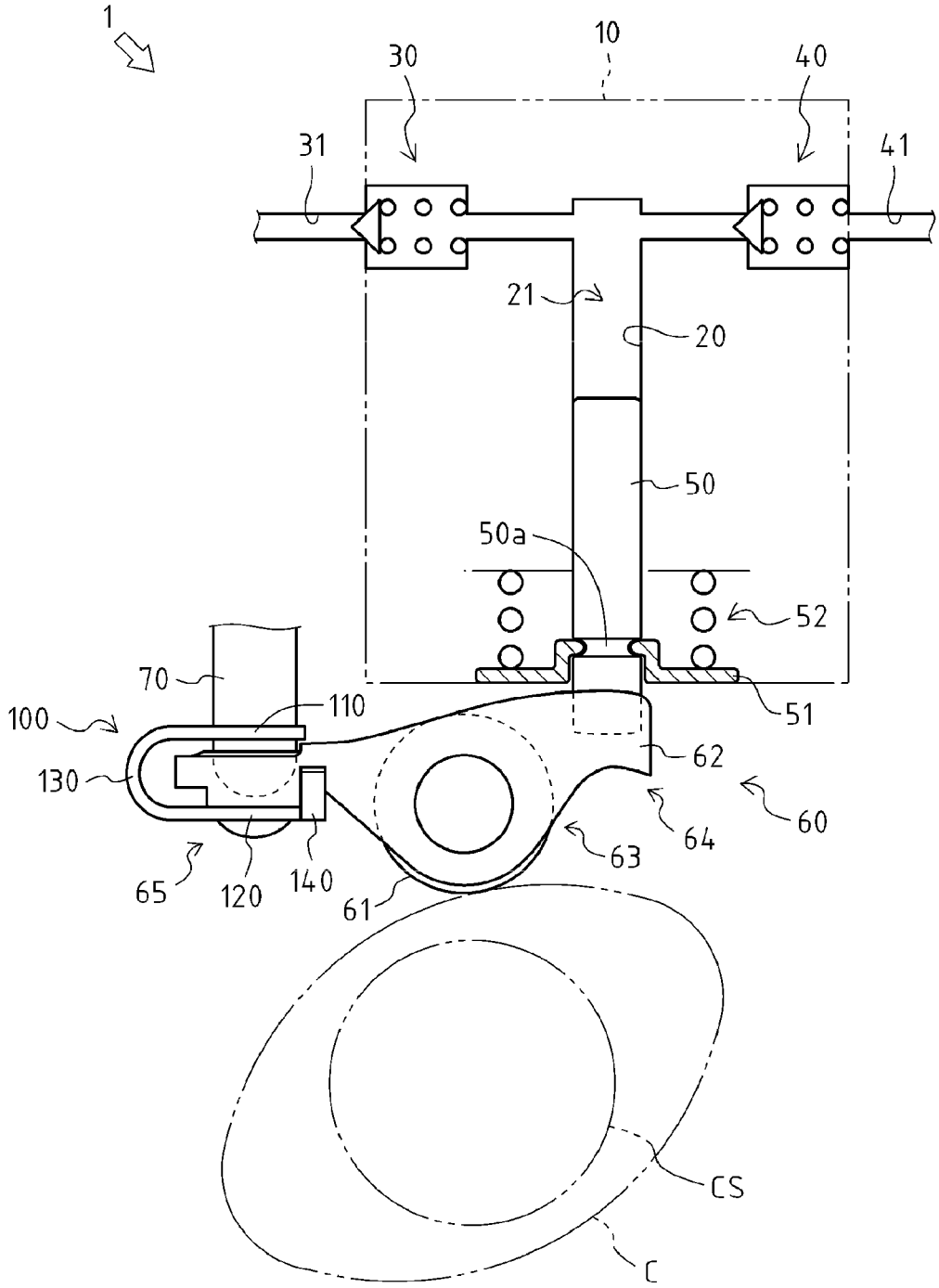
FIG. 1 illustrates a high-pressure pump according to a first embodiment of the present invention.

Note that a top-bottom direction and a right-left direction in FIG. 1 are defined as a top-bottom direction and a right-left direction of the high-pressure pump 1, respectively. Additionally, this side in FIG. 1 is defined as a front of the high-pressure pump 1, and the far side in FIG. 1 is defined as a rear of the high-pressure pump 1.

As shown in FIG. 1, the high-pressure pump 1 includes a housing 10 in which various members are housed, a cylinder 20 provided in the housing 10, a first check valve 30 permitting only the inflow of the fuel into the cylinder 20, a second check valve 40 permitting only the outflow of the fuel from the cylinder 20, a plunger 50 reciprocating in the cylinder 20, a rocker arm 60 actuating the plunger 50 by rocking in association with a rotation of a cam C, a pivot 70 supporting the rocker arm 60 in a rockable manner, and an mounting member 100 fixed to the pivot 70.

The housing 10 accommodates the cylinder 20, the first check valve 30, the second check valve 40, and the plunger 50. The housing 10 is attached to a cam cap CC (see FIG. 2) supporting a cam shaft CS of the internal-combustion engine in a rotatable manner.

The cylinder 20 is a hollow member configured so that the plunger 50 can slide therein. Inside the cylinder 20, a pressurizing chamber 21 is formed.

The pressurizing chamber 21 is a space in the cylinder 20 formed above the plunger 50 inserted into the cylinder 20 from below.

The first check valve 30 is provided on the flow path of the fuel, and is arranged between a low-pressure fuel passage 31 communicating with a fuel tank (not shown) in which the fuel is stored and the pressurizing chamber 21. The first check valve 30 restricts the flow direction of the fuel so that the fuel supplied from the fuel tank to the pressurizing chamber 21 through the low-pressure fuel passage 31 does not flow from the pressurizing chamber 21 to the low-pressure fuel passage 31. In short, the first check valve 30 permits only the inflow of the fuel into the pressurizing chamber 21 of the cylinder 20.

The second check valve 40 is, as with the first check valve 30, provided on the flow path of the fuel, and is arranged between a high-pressure fuel passage 41 communicating with a delivery pipe (not shown) for supplying the fuel to the fuel-injection valves of the internal-combustion engine and the pressurizing chamber 21. The second check valve 40 restricts the flow direction of the fuel so that the fuel discharged from the pressurizing chamber 21 to the high-pressure fuel passage 41 does not return to the pressurizing chamber 21. In short, the second check valve 40 permits only the outflow of the fuel from the pressurizing chamber 21 of the cylinder 20.

The plunger 50 is a rod sliding in the top-bottom direction in the cylinder 20 in association with the rock of the rocker arm 60. The plunger 50 forms the pressurizing chamber 21 in the cylinder 20.

When the plunger 50 moves in a direction (the bottom direction) to increase the volume of the pressurizing chamber 21, the pressure in the pressurizing chamber 21 decreases. It follows from this that the fuel in the low-pressure fuel passage 31 presses and opens the first check valve 30, and flows into the pressurizing chamber 21.

On the other hand, when the plunger 50 moves in a direction (the top direction) to decrease the volume of the pressurizing chamber 21, the pressure in the pressurizing chamber 21 increases. It follows from this that the fuel in the pressurizing chamber 21 presses and opens the second check valve 40, and flows to the high-pressure fuel passage 41.

On the lower part of the plunger 50, a groove 50*a* is formed.

The groove 50*a* is formed by recessing the outer circumferential surface of the plunger 50 throughout the whole area in the circumferential direction of the plunger 50. The groove 50*a* is formed so that a retainer 51 is attached thereto.

The retainer 51 is an annular member, and is fixed to the groove 50*a* so that the inner circumferential surface of the retainer 51 comes in contact with the surface of the groove 50*a* of the plunger 50. The retainer 51 is a member to which a spring 52 is attached so as to bias the plunger 50 downward.

The spring 52 biases the plunger 50 downward through the retainer 51. One end part (the bottom end part) of the spring 52 is attached to the top surface of the retainer 51, and the other end part (the top end part) of the spring 52 is attached to a predetermined part of the housing 10.

Figure 2:
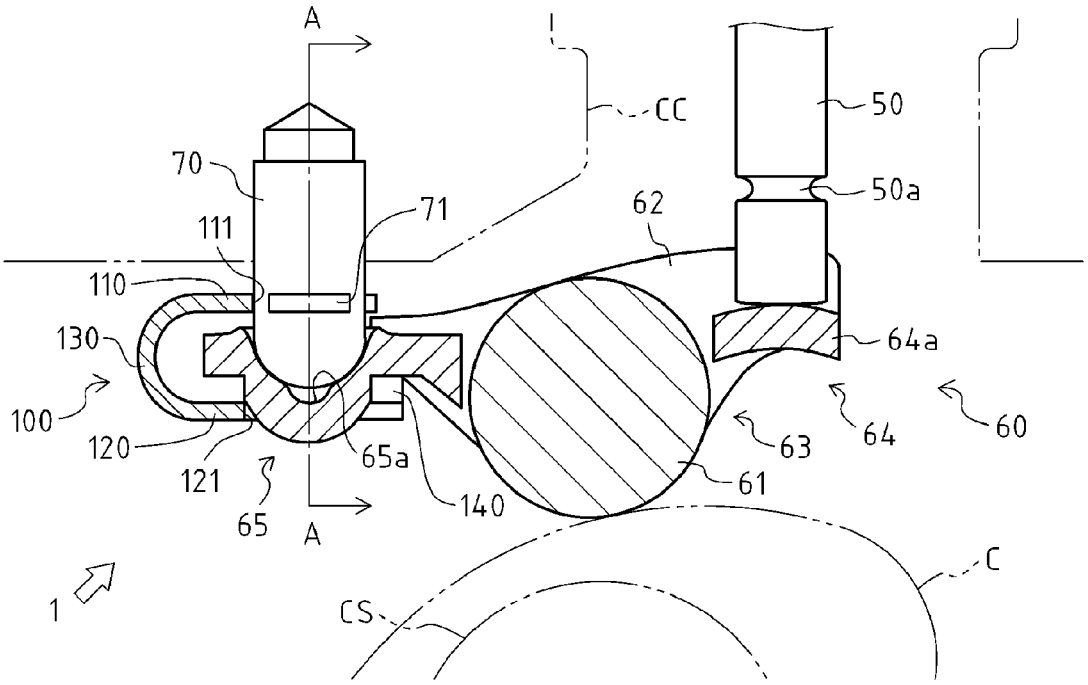
FIG. 2 illustrates a structure of the operating high-pressure pump according to a first embodiment of the present invention in the vicinity of a rocker arm.

As shown in FIGS. 1 and 2, the rocker arm 60 is a member for actuating the plunger 50 by rocking in association with the rotation of the cam C, and has a roller 61 rolling on the outer circumferential surface of the cam C, and an arm body 62 supporting the roller 61 in a rotatable manner.

Note that, in FIG. 2, for convenience, the retainer 51 and the spring 52 are not illustrated.

The roller 61 is provided so that the outer circumferential surface thereof comes in contact with the outer circumferential surface of the cam C, and is arranged on the top of the cam C so as to rotate on the axis parallel to the cam shaft CS. The roller 61 rolls on the outer circumferential surface of the cam C in association with the rotation of the cam C.

The arm body 62 supports the roller 61 in a rotatable manner in the middle part in the right-left direction of the arm body 62, and forms an exterior of the rocker arm 60. The arm body 62 has a roller-attached part 63 to which the roller 61 is attached, a first end 64 protruding rightward from the roller-attached part 63, and a second end 65 protruding leftward from the roller-attached part 63.

The roller-attached part 63 is situated in the middle part in the right-left direction of the arm body 62. The roller-attached part 63 has a pair of sidewalls which supports the roller 61 therebetween from the opposite sides in the axial direction of the roller 61. In other words, the roller-attached part 63 has open-topped and open-bottomed shape, and supports the roller 61. The bottom end part of each of the pair of sidewalls is formed in an arc along the shape of the lower part of the roller 61 so that the roller 61 is slightly exposed and that the outer circumferential surface of the roller 61 comes in contact with the outer circumferential surface of the cam C.

The first end 64 is situated in the right end part of the arm body 62. The first end 64 has a pair of sidewalls which is continuous with the pair of sidewalls of the roller-attached part 63, and a contact part 64*a* provided between the pair of sidewalls of the first end 64.

The pair of sidewalls of the first end 64 extends rightward while verging slightly upward, and gradually decreases in dimension in the top-bottom direction toward the right end thereof.

The contact part 64*a* is a plate connecting to the separated sidewalls of the first end 64. The contact part 64*a* is substantially horizontally formed from the right end parts of the sidewalls of the first end 64 to the vicinity of the right side of the roller 61, and is arranged below the top end parts of the sidewalls of the first end 64. In other words, the first end 64 is formed in substantially U-shape as seen from the right.

The top surface of the contact part 64*a* is in contact with the bottom end part of the plunger 50. Therefore, when the rocker arm 60 rocks up and down, the plunger 50 reciprocates in the top-bottom direction.

The second end 65 is situated in the left end part of the arm body 62. The second end 65 is formed in a plate protruding substantially horizontally from the vicinity of the left side of the roller 61 toward the left, and is joined to the pair of sidewalls of the roller-attached part 63.

The second end 65 has a concave 65*a* in which the pivot 70 is provided.

The concave 65*a* is formed by recessing the middle part in the right-left direction of the second end 65 from above, and by protruding the bottom surface of the second end 65. The second end 65 is formed in substantially a semispherical shape.

The pivot 70 is a rod which is fixed to a predetermined part of the cam cap CC, and which extends downward from the part thereof. The pivot 70 has a protruding end part (the bottom end part) formed in substantially a semispherical shape coinciding substantially with the shape of the inner circumferential surface of the concave 65*a*. The pivot 70 is arranged in the concave 65*a* so that the outer circumferential surface of the protruding end part comes in contact with the inner circumferential surface of the concave 65*a*.

A hydraulic lash adjuster, for example, may be adopted as the pivot 70.

Thus, the rocker arm 60 is provided on the top of the cam C so that the outer circumferential surface of the roller 61 comes in contact with the outer circumferential surface of the cam C in a state where the pivot 70 is arranged in the concave 65*a* formed in the second end 65, and where the bottom end part of the plunger 50 comes in contact with the top surface of the contact part 64*a* of the first end 64. When the cam C rotates, the roller 61 of the rocker arm 60 rolls on the outer circumferential surface of the cam C, and the rocker arm 60 rocks up and down around the second end 65 depending on a cam profile of the cam C. As a result, the plunger 50 in contact with the top surface of the first end 64 of the rocker arm 60 reciprocates in the top-bottom direction.

Figure 3:
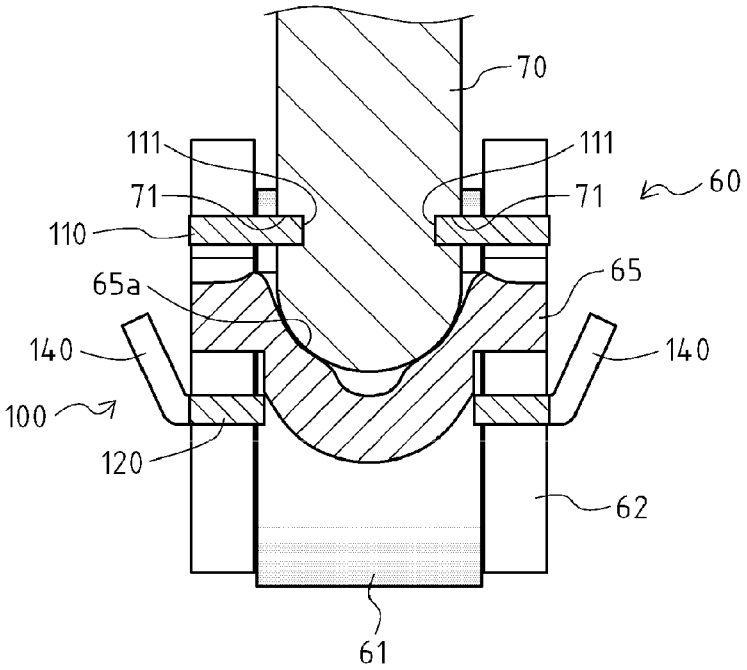
FIG. 3 is a sectional view taken along the line A-A in FIG. 2.

As shown in FIGS. 2 and 3, the mounting member 100 has a shape similar to a plate curved in substantially U-shape. The mounting member 100 includes a fixed part 110, a supporting part 120, and a curved part 130.

The fixed part 110 extends in the right-left direction while maintaining a width (dimension in the right-left direction in FIG. 3) thereof comparable to that of the second end 65 of the rocker arm 60, and is arranged above the second end 65. The fixed part 110 is arranged so that a predetermined clearance is formed between the fixed part 110 and the second end 65 of the rocker arm 60 when the rocker arm 60 is mounted (when the pivot 70 is arranged in the concave 65*a* of the second end 65, and the plunger 50 is brought into contact with the contact part 64*a* of the first end 64). Moreover, the fixed part 110 is arranged to be out of contact with the second end 65 during the operation of the high-pressure pump 1.

The fixed part 110 has a locking part 111 formed by cutting into the fixed part 110 from the right end part thereof.

Figure 4:
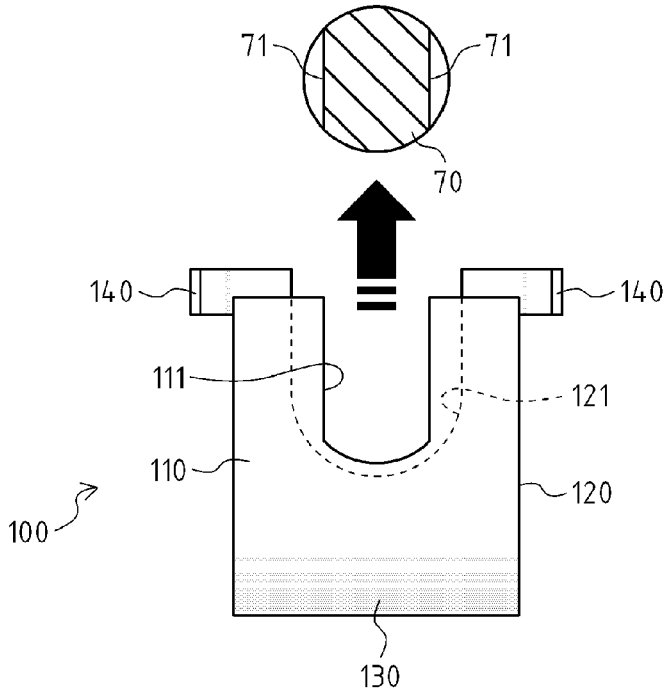
FIG. 4 is a partly sectional view showing how a mounting member is attached to a pivot.

As shown in FIG. 4, the locking part 111 is formed to engage with locking grooves 71 formed on the front and rear parts of the outer circumferential surface of the pivot 70. The locking part 111 is formed by cutting into the middle part in the front-rear direction of the fixed part 110 from the right end part to the halfway part in the right-left direction thereof. Therefore, it is possible to easily fix the fixed part 110 to the pivot 70 by fitting the fixed part 110 to the pivot 70 from the right end part of the fixed part 110 so that the locking part 111 engages with the locking grooves 71. Moreover, it is possible to easily remove the fixed part 110 from the pivot 70 by pulling out the fixed part 110 leftward.

The locking grooves 71 are formed on the front and rear parts of the outer circumferential surface of the pivot 70, and engage with the locking part 111 of the fixed part 110. The locking grooves 71 are formed by cutting off the front and rear parts of the pivot 70 rectangularly as seen in the right-left direction (see FIG. 3). Each of the locking grooves 71 has a dimension in the top-bottom direction comparable to the thickness (dimension in the top-bottom direction in FIG. 3) of the fixed part 110.

As shown in FIGS. 2 and 3, the supporting part 120 extends in the right-left direction while maintaining a width (dimension in the right-left direction in FIG. 3) thereof comparable to that of the fixed part 110. The supporting part 120 is arranged below the second end 65 so as to be opposed to the fixed part 110 across the second end 65 of the rocker arm 60. The supporting part 120 is arranged so that a predetermined clearance is formed between the supporting part 120 and the second end 65 of the rocker arm 60 when the rocker arm 60 is mounted (when the pivot 70 is arranged in the concave 65*a* of the second end 65, and the plunger 50 is brought into contact with the contact part 64*a* of the first end 64). Moreover, the supporting part 120 is arranged to be out of contact with the second end 65 during the operation of the high-pressure pump 1.

The supporting part 120 has an avoiding part 121 formed by cutting into the supporting part 120 from the right end part thereof.

The avoiding part 121 is formed by cutting into the middle part in the front-rear direction of the supporting part 120 from the right end part to the halfway part in the right-left direction thereof so that the supporting part 120 is out of interference with the concave 65*a* of the second end 65 of the rocker arm 60 when the mounting member 100 is attached to the pivot 70.

The curved part 130 is formed to connect to the left end part of the fixed part 110 and the left end part of the supporting part 120, and is curved to come out of contact with the second end 65 of the rocker arm 60.

The mounting member 100 mentioned above supports the rocker arm 60 so as to prevent the rocker arm 60 from tilting around the roller 61 with a downward movement of the second end 65 under the weight of the rocker arm 60 and consequently from falling down from the cam C when the rocker arm 60 is mounted (when the plunger 50 comes out of contact with the contact part 64*a* of the first end 64).

Figure 5:
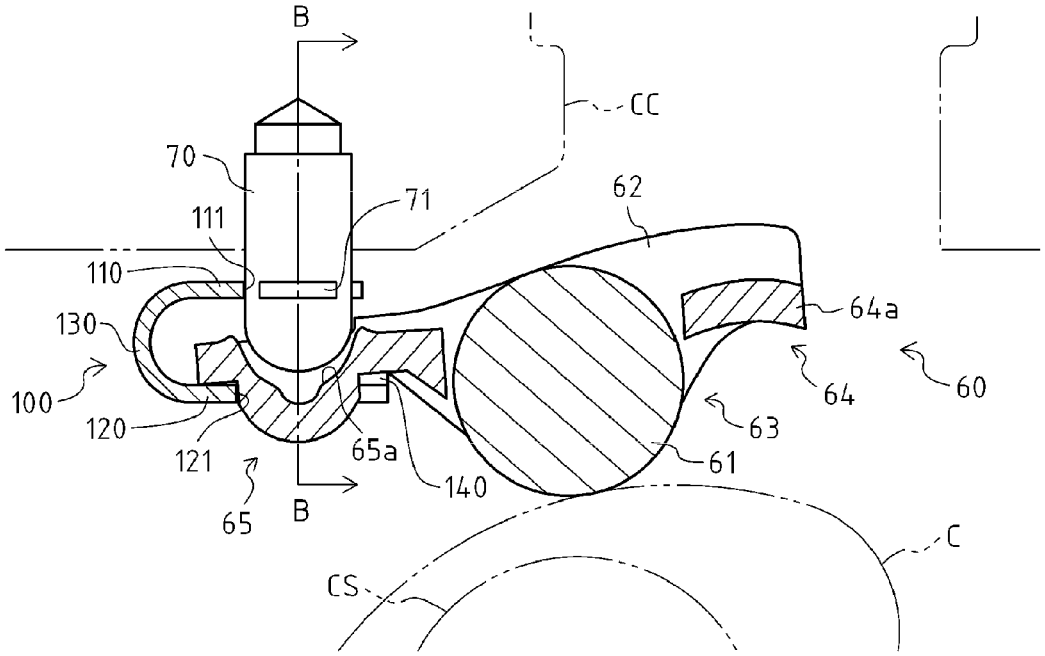
FIG. 5 is a partly sectional view showing how the rocker arm is mounted.

As shown in FIG. 5, when the rocker arm 60 is mounted, the rocker arm 60 in which the pivot 70 is arranged in the concave 65*a* of the second end 65 tilts toward the second end 65 around the roller 61 under the weight of the rocker arm 60. Then, the supporting part 120 of the mounting member 100 comes in contact with the part of the second end 65 of the rocker arm 60 except the concave 65*a*, and thereby the mounting member 100 supports the rocker arm 60. At this time, the pivot 70 is loosely provided in the concave 65*a* of the second end 65. Specifically, in a state where the outer circumferential surface of the protruding end part (the bottom end part) of the pivot 70 is out of contact with the inner circumferential surface of the concave 65*a*, the protruding end part of the pivot 70 is positioned within the concave 65*a*.

Note that the position of the supporting part 120 of the mounting member 100 is adjusted so that the supporting part 120 supports the rocker arm 60 in a state where the outer circumferential surface of the protruding end part of the pivot 70 is out of contact with the inner circumferential surface of the concave 65*a*, and where the protruding end part of the pivot 70 is positioned within the concave 65*a*.

In the rocker arm 60 supported by the mounting member 100, when the plunger 50 is brought into contact with the contact part 64*a* of the first end 64, the first end 64 moves downward and the second end 65 moves upward to such a position that the second end 65 comes out of contact with the fixed part 110 of the mounting member 100. As a result, during the operation of the high-pressure pump 1 (see FIGS. 1 and 2), the rocker arm 60 rocks without contact with the mounting member 100.

Thus, when the rocker arm 60 is mounted, the rocker arm 60 is supported by the mounting member 100 in a state where the protruding end part of the pivot 70 is positioned within the concave 65*a* and where the outer circumferential surface of the protruding end part of the pivot 70 is apart from the inner circumferential surface of the concave 65*a* of the second end 65. Moreover, after mounting the rocker arm 60, namely, during the operation of the high-pressure pump 1, the rocker arm 60 rocks without contact with the mounting member 100.

This makes it possible to prevent the rocker arm 60 from tilting around the roller 61 with a downward movement of the second end 65 under the weight of the rocker arm 60 and consequently from falling down from the cam C, when the rocker arm 60 is mounted. Therefore, it is possible to easily mount the rocker arm 60, and consequently to easily install the high-pressure pump 1 in the internal-combustion engine.

In the present embodiment, the fixed part 110 of the mounting member 100 extends in the right-left direction to fix to the pivot 70, but a means for fixing the mounting member 100 is not limited to this configuration.

Figure 6:
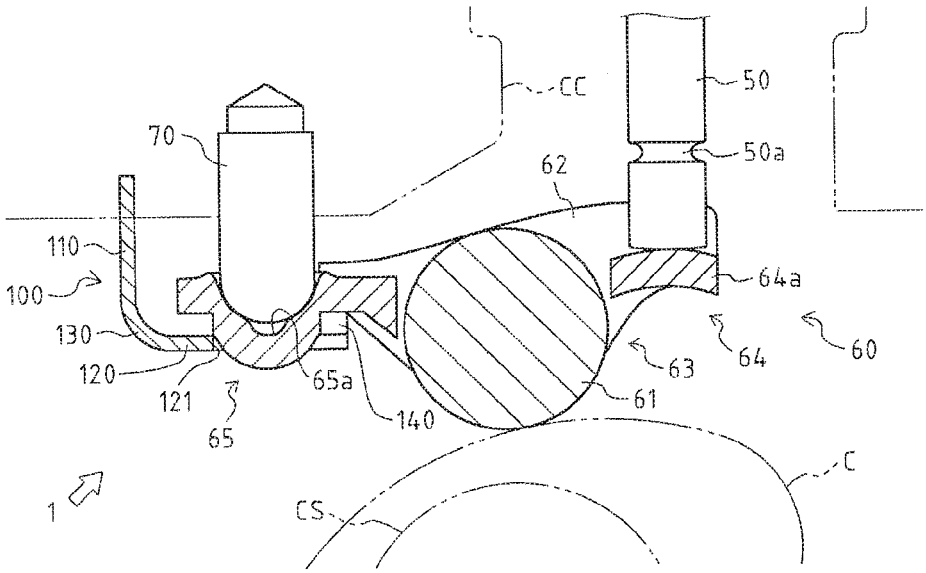
FIG. 6 illustrates the mounting member according to an alternative embodiment of the present invention.

For example, as shown in FIG. 6, the fixed part 110 may extend vertically so that the top end part thereof is fixed to the part of the cam cap CC situated to the left of the pivot 70. In this case, it is unnecessary to form the locking grooves 71 on the pivot 70.

Moreover, the mounting member 100 includes a pair of anti-turning parts 140.

As shown in FIGS. 1 to 3, the anti-turning parts 140 are plates protruding upward from the right end part of the supporting part 120 of the mounting member 100, and form such a shape (taper shape) that a distance therebetween gradually increases toward the top ends thereof. A distance between the base end parts (the parts in which the anti-turning parts 140 and the supporting part 120 are joined) of the anti-turning parts 140 is set at substantially a width (dimension in the right-left direction in FIG. 3) of the second end 65 of the rocker arm 60.

Figure 7:
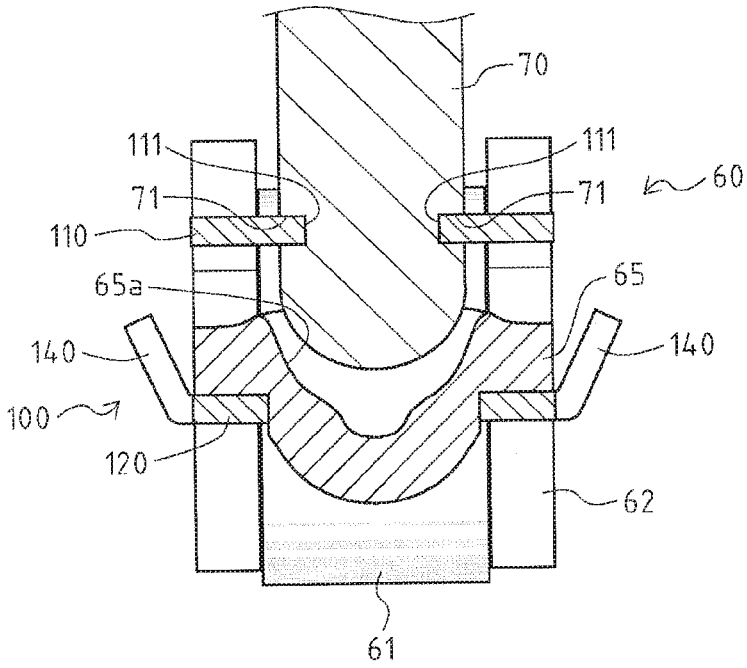
FIG. 7 is a sectional view taken along the line B-B in FIG. 5.

As shown in FIG. 7, when the rocker arm 60 is mounted, the second end 65 of the rocker arm 60 supported by the supporting part 120 of the mounting member 100 is held by the base end parts of the anti-turning parts 140 therebetween.

This makes it possible to prevent the rocker arm 60 from moving in the front-rear direction around the pivot 70 and consequently to bring the plunger 50 into contact with the contact part 64*a* of the first end 64 of the rocker arm 60 with accuracy, when the rocker arm 60 is mounted. Therefore, it is possible to more easily mount the rocker arm 60, and consequently to more easily install the high-pressure pump 1 in the internal-combustion engine.

As mentioned previously, since the anti-turning parts 140 are tapered, the anti-turning parts 140 come out of interference with the second end 65 of the rocker arm 60 after mounting the rocker arm 60, namely, during the operation of the high-pressure pump 1 (see FIG. 3). This makes it possible to prevent the rocker arm 60 from rocking in the front-rear direction around the pivot 70 during the operation of the high-pressure pump 1. Therefore, it is possible to prevent the anti-turning parts 140 from coming in contact with the second end 65, and consequently from being damaged.

The anti-turning parts 140 may be configured as follows.

Figure 8:
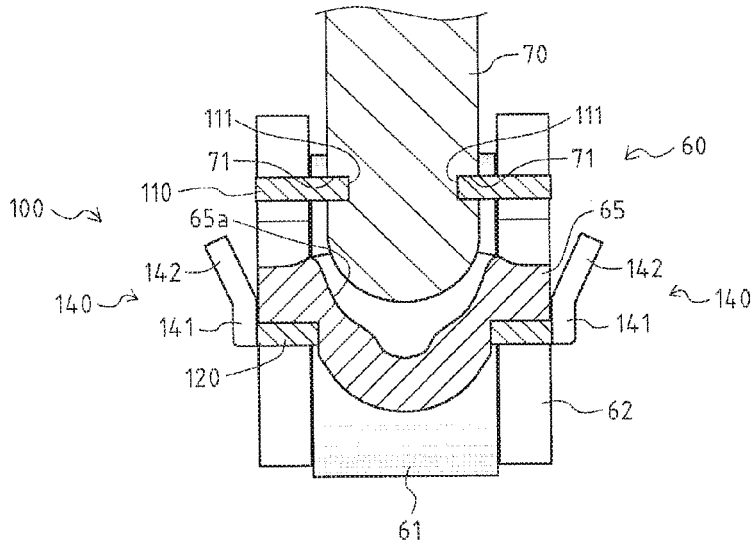
FIG. 8 illustrates an anti-turning part according to an alternative embodiment of the present invention.

As shown in FIG. 8, the anti-turning parts 140 have a pair of vertical parts 141 extending in the top-bottom direction, and a pair of inclined parts 142 formed in a taper.

The vertical parts 141 protrude upward from the right end part of the supporting part 120 of the mounting member 100 while maintaining a distance therebetween.

The inclined parts 142 protrude upward from the protruding end parts (the top end parts) of the vertical parts 141, and incline to gradually increase in distance therebetween toward the top ends thereof.

In the anti-turning parts 140 configured in this manner, when the rocker arm 60 is mounted, the vertical parts 141 of the anti-turning parts 140 hold the second end 65 of the rocker arm 60 supported by the supporting part 120 of the mounting member 100 therebetween.

This makes it possible to bring the plunger 50 into contact with the contact part 64*a* of the first end 64 of the rocker arm 60 with high accuracy without a movement of the rocker arm 60 in the front-rear direction around the pivot 70 when the rocker arm 60 is mounted. Therefore, it is possible to more easily mount the rocker arm 60, and consequently to more easily install the high-pressure pump 1 in the internal-combustion engine.

Moreover, since the inclined parts 142 of the anti-turning parts 140 are tapered, the inclined parts 142 come out of interference with the second end 65 of the rocker arm 60 after mounting the rocker arm 60, namely, during the operation of the high-pressure pump 1. This makes it possible to prevent the rocker arm 60 from rocking in the front-rear direction around the pivot 70 during the operation of the high-pressure pump 1. Therefore, it is possible to prevent the anti-turning parts 140 from coming in contact with the second end 65, and consequently from being damaged. Note that a height (dimension in the top-bottom direction) of each vertical part 141 is adjusted so that each vertical part 141 comes out of contact with the second end 65 of the rocker arm 60 during the operation of the high-pressure pump 1.

Second Embodiment

Figure 9:
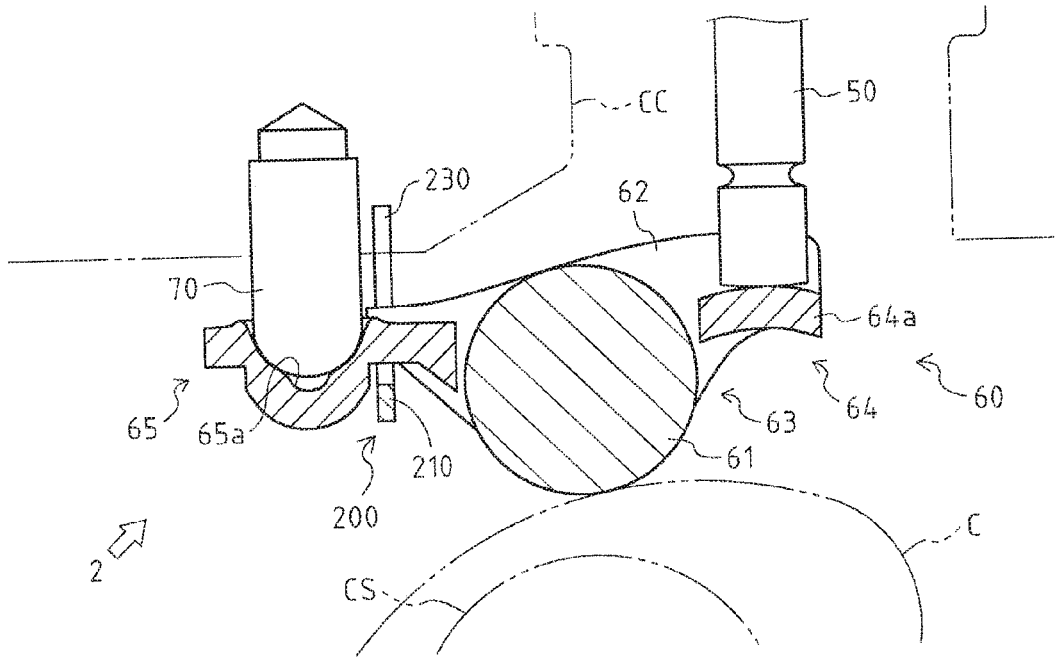
FIG. 9 illustrates a structure of the operating high-pressure pump according to a second embodiment of the present invention in the vicinity of the rocker arm.
Figure 10:
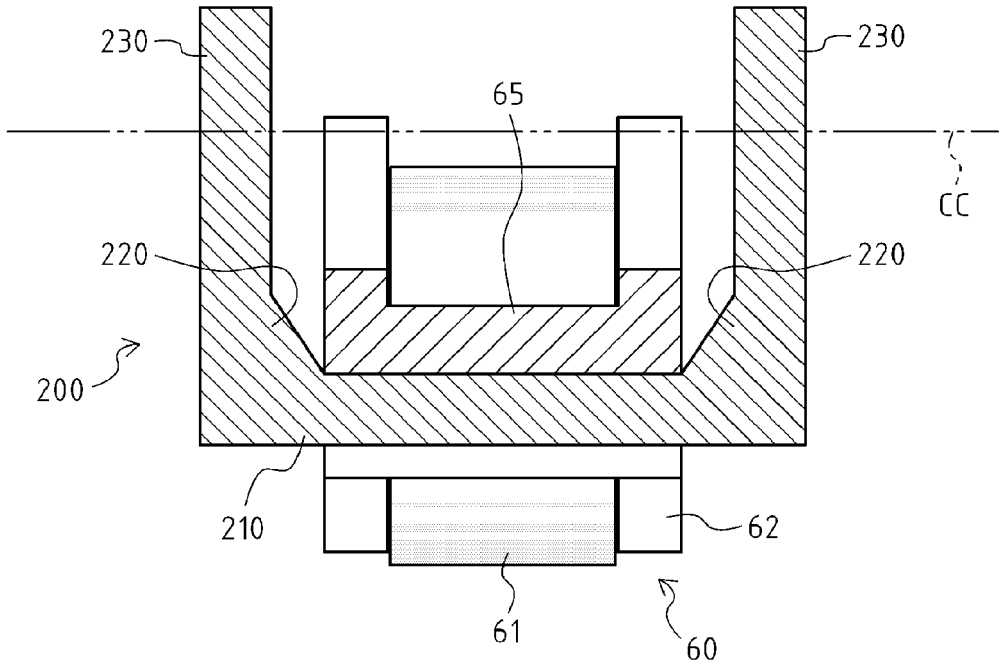
FIG. 10 is a sectional view showing how the rocker arm is mounted.

With reference to FIGS. 9 and 10, described below is a high-pressure pump 2 as a second embodiment of a high-pressure pump according to the present invention.

The high-pressure pump 2 is substantially similar in configuration to the high-pressure pump 1.

Note that, hereinafter, the parts common to the high-pressure pump 1 and the high-pressure pump 2 are indicated by same reference signs, and descriptions thereof are omitted.

As shown in FIG. 9, the high-pressure pump 2 differs from the high-pressure pump 1 in having a mounting member 200 instead of the mounting member 100.

Note that the locking grooves 71 are not formed on the pivot 70 of the high-pressure pump 2.

As shown in FIGS. 9 and 10, the mounting member 200 is a plate extending in the top-bottom direction while maintaining a wider width (dimension in the right-left direction in FIG. 10) thereof than that of the second end 65 of the rocker arm 60, and the top end part of the mounting member 200 is fixed to the cam cap CC. The mounting member 200 is arranged to the right of the pivot 70 within an area in the right-left direction in which the second end 65 is situated.

The mounting member 200 is formed in substantially U-shape by cutting into the middle part in the front-rear direction thereof from the top end part to the halfway part in the top-bottom direction thereof. The mounting member 200 has a supporting part 210, a pair of anti-turning parts 220, and a pair of fixed parts 230.

The supporting part 210 is situated in the bottom end part of the mounting member 200. The supporting part 210 is formed so that a predetermined clearance is formed between the supporting part 210 and the second end 65 of the rocker arm 60 when the rocker arm 60 is mounted (when the pivot 70 is arranged in the concave 65*a* of the second end 65, and the plunger 50 is brought into contact with the contact part 64*a* of the first end 64 as shown in FIG. 9). Moreover, the supporting part 210 is formed to be out of contact with the second end 65 during the operation of the high-pressure pump 2.

As shown in FIG. 10, the supporting part 210 comes in contact with the second end 65 from below when the rocker arm 60 is mounted (when the plunger 50 comes out of contact with the contact part 64*a* of the first end 64), thereby supporting the rocker arm 60 in a state where the protruding end part of the pivot 70 is positioned within the concave 65*a* and where the outer circumferential surface of the protruding end part of the pivot 70 is apart from the inner circumferential surface of the concave 65*a* of the second end 65.

This makes it possible to prevent the rocker arm 60 from tilting around the roller 61 with a downward movement of the second end 65 under the weight of the rocker arm 60 and consequently from falling down from the cam C, when the rocker arm 60 is mounted. Therefore, it is possible to easily mount the rocker arm 60, and consequently to easily install the high-pressure pump 2 in the internal-combustion engine.

The anti-turning parts 220 protrude upward from both the end parts in the front-rear direction of the supporting part 210. The anti-turning parts 220 are formed to gradually decrease in width (dimension in the right-left direction in FIG. 10) and to gradually increase in distance therebetween toward the top ends thereof. In other words, the opposed surfaces of the anti-turning parts 220 incline to gradually separate from each other toward the top ends thereof. A distance between the base end parts (the parts in which the opposed surfaces are the most close to each other) of the anti-turning parts 220 is set at substantially a width (dimension in the right-left direction in FIG. 10) of the second end 65 of the rocker arm 60.

The anti-turning parts 220 hold the second end 65 therebetween when the rocker arm 60 is mounted, thus enabling to prevent the rocker arm 60 from moving in the front-rear direction around the pivot 70, and consequently to bring the plunger 50 into contact with the contact part 64*a* of the first end 64 of the rocker arm 60 with accuracy. Therefore, it is possible to more easily mount the rocker arm 60, and consequently to more easily install the high-pressure pump 2 in the internal-combustion engine.

As mentioned previously, since the opposed surfaces of the anti-turning parts 220 incline to gradually separate from each other toward the top ends thereof, the anti-turning parts 220 come out of interference with the second end 65 of the rocker arm 60 after mounting the rocker arm 60, namely, during the operation of the high-pressure pump 2. This makes it possible to prevent the rocker arm 60 from rocking in the front-rear direction around the pivot 70 during the operation of the high-pressure pump 2. Therefore, it is possible to prevent the anti-turning parts 220 from coming in contact with the second end 65, and consequently from being damaged.

On the other hand, the lower parts of the opposed surfaces of the anti-turning parts 220 may be vertically formed. Therefore, the anti-turning parts 220 enable, as with the vertical parts 141 of the anti-turning parts 140 of the mounting member 100, bringing the plunger 50 into contact with the contact part 64*a* of the first end 64 of the rocker arm 60 with high accuracy without a movement of the rocker arm 60 in the front-rear direction around the pivot 70 when the rocker arm 60 is mounted.

The fixed parts 230 protrude upward from the top end parts of the anti-turning parts 220 while maintaining each width (dimension in the right-left direction in FIG. 10) thereof. The protruding end parts (the top end parts) of the fixed parts 230 are fixed to the cam cap CC.

Third Embodiment

Figure 11:
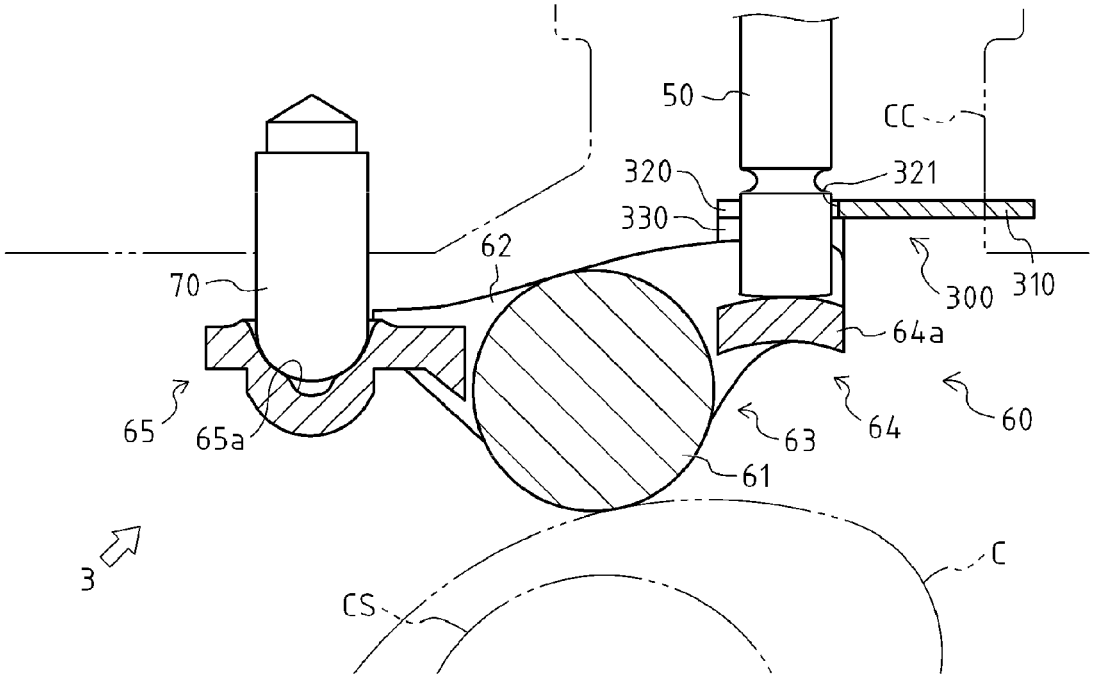
FIG. 11 illustrates a structure of the operating high-pressure pump according to a third embodiment of the present invention in the vicinity of the rocker arm.
Figure 12:
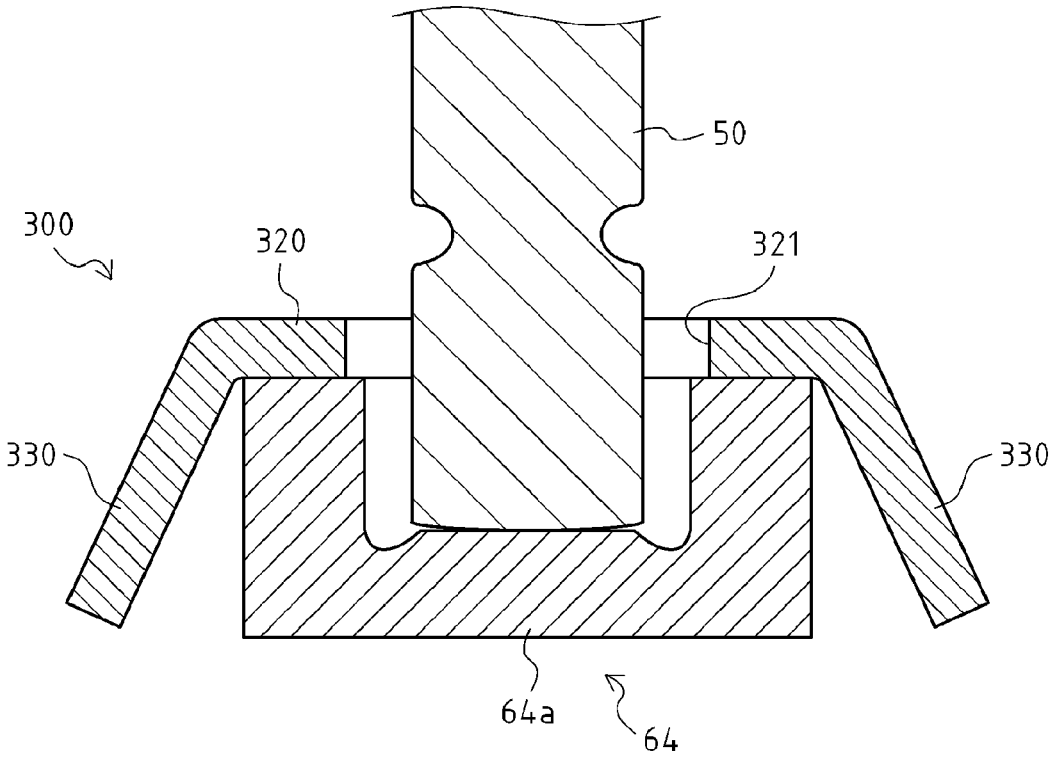
FIG. 12 is a sectional view showing how the rocker arm is mounted.

With reference to FIGS. 11 and 12, described below is a high-pressure pump 3 as a third embodiment of a high-pressure pump according to the present invention.

The high-pressure pump 3 is substantially similar in configuration to the high-pressure pump 1.

Note that, hereinafter, the parts common to the high-pressure pump 1 and the high-pressure pump 3 are indicated by same reference signs, and descriptions thereof are omitted.

As shown in FIG. 11, the high-pressure pump 3 differs from the high-pressure pump 1 in having a mounting member 300 instead of the mounting member 100.

Note that the locking grooves 71 are not formed on the pivot 70 of the high-pressure pump 3.

As shown in FIGS. 11 and 12, the mounting member 300 has a fixed part 310, a supporting part 320, and a pair of anti-turning parts 330.

The fixed part 310 is a plate extending in the right-left direction in an area to the right of the right end part of the contact part 64*a* of the first end 64, and is arranged above the first end 64. The right end part of the fixed part 310 is fixed to the cam cap CC.

The supporting part 320 is a plate extending in the right-left direction in an area from the left end part to the right end part of the contact part 64*a* of the first end 64 while maintaining a width (dimension in the right-left direction in FIG. 12) thereof comparable to that of the second end 65 of the rocker arm 60. The supporting part 320 is arranged above the first end 64, and is integrally joined to the fixed part 310. The supporting part 320 is formed so that a predetermined clearance is formed between the supporting part 320 and the first end 64 when the rocker arm 60 is mounted (when the pivot 70 is arranged in the concave 65*a* of the second end 65, and the plunger 50 is brought into contact with the contact part 64*a* of the first end 64 as shown in FIG. 11). Moreover, the supporting part 320 is formed to be out of contact with the first end 64 during the operation of the high-pressure pump 3.

The supporting part 320 has an avoiding part 321 formed by cutting into the middle part in the front-rear direction thereof from the left end part thereof, and the avoiding part 321 enables the supporting part 320 to avoid contact with the plunger 50.

As shown in FIG. 12, the supporting part 320 comes in contact with the first end 64 from above when the rocker arm 60 is mounted (when the plunger 50 comes out of contact with the contact part 64*a* of the first end 64), thereby supporting the rocker arm 60 in a state where the protruding end part of the pivot 70 is positioned within the concave 65*a* and where the outer circumferential surface of the protruding end part of the pivot 70 is apart from the inner circumferential surface of the concave 65*a* of the second end 65.

This makes it possible to prevent the rocker arm 60 from tilting around the roller 61 with a upward movement of the first end 64 under the weight of the rocker arm 60, and consequently from falling down from the cam C. Therefore, it is possible to easily mount the rocker arm 60, and consequently to easily install the high-pressure pump 3 in the internal-combustion engine.

The anti-turning parts 330 are plates protruding downward from both the end parts in the front-rear direction of the supporting part 320, and are arranged so that a position in the right-left direction of each anti-turning part 330 coincides with that of the contact part 64*a* of the first end 64 in the rocker arm 60. The anti-turning parts 330 form such a shape (taper shape) that a distance therebetween gradually increases toward the bottom ends thereof. A distance between the base end parts (the parts in which the anti-turning parts 330 and the supporting part 320 are joined) of the anti-turning parts 330 is set at substantially a width (dimension in the right-left direction in FIG. 12) of the first end 64 of the rocker arm 60.

The anti-turning parts 330 hold the first end 64 therebetween when the rocker arm 60 is mounted, thus enabling to prevent the rocker arm 60 from moving in the front-rear direction around the pivot 70, and consequently to bring the plunger 50 into contact with the contact part 64*a* of the first end 64 of the rocker arm 60 with accuracy. In particular, the anti-turning parts 330 are arranged to come in contact with the first end 64 situated far from the pivot 70 as an axis around which the rocker arm 60 rocks, thereby enabling to bring the plunger 50 into contact with the contact part 64*a* of the first end 64 of the rocker arm 60 with high accuracy when preventing the first end 64 from moving in the front-rear direction. Therefore, it is possible to more easily mount the rocker arm 60, and consequently to more easily install the high-pressure pump 3 in the internal-combustion engine.

As mentioned previously, since the anti-turning parts 330 are tapered, the anti-turning parts 330 come out of interference with the first end 64 of the rocker arm 60 after mounting the rocker arm 60, namely, during the operation of the high-pressure pump 3. This makes it possible to prevent the rocker arm 60 from rocking in the front-rear direction around the pivot 70 during the operation of the high-pressure pump 3. Therefore, it is possible to prevent the anti-turning parts 330 from coming in contact with the first end 64, and consequently from being damaged.

On the other hand, the base end parts (the top end parts) of the anti-turning parts 330 may be vertically formed. Therefore, the anti-turning parts 330 enable, as with the vertical parts 141 of the anti-turning parts 140 of the mounting member 100, bringing the plunger 50 into contact with the contact part 64*a* of the first end 64 of the rocker arm 60 with high accuracy without a movement of the rocker arm 60 in the front-rear direction around the pivot 70 when the rocker arm 60 is mounted.

As mentioned above, a mounting member provided in a high-pressure pump according to the present invention is configured to, at least, resist a turn of a rocker arm around a roller under the weight thereof by coming in contact with an arm body thereof. A mounting member, such as the mounting member 100 and the mounting member 200, configured to come in contact with the second end 65 from below, or a mounting member, such as the mounting member 300, configured to come in contact with the first end 64 from above may be adopted as the mounting member provided in the high-pressure pump according to the present invention.

INDUSTRIAL APPLICABILITY

The present invention is applied to a high-pressure pump including a rocker arm which is mounted on a cam of an internal-combustion engine and which has a roller.

REFERENCE SIGNS LIST

1: high-pressure pump
10: housing
20: cylinder
30: first check valve
40: second check valve
50: plunger
60: rocker arm
61: roller
62: arm body
63: roller-attached part
64: tip part
65: base end part
70: pivot
100: mounting member
110: fixed part
120: supporting part
140: anti-turning part
C: cam
CS: cam shaft
CC: cam cap

The invention claimed is:

1. A high-pressure pump to be installed in an internal-combustion engine having a cam shaft, comprising:

a rocker arm which is mounted on a cam provided on the cam shaft of the internal-combustion engine, and which rocks in association with a rotation of the cam;

a pivot which protrudes downward, and a lower end part of which supports the rocker arm in a rockable manner;

a plunger which reciprocates in a top-bottom direction in association with a movement of the rocker arm; and a mounting member which is fixed at a predetermined position, wherein the rocker arm comprises:

a roller which rotates on an axis parallel to the cam shaft, and which rolls on the outer circumferential surface of the cam; and an arm body which supports the roller in a rotatable manner, wherein the arm body comprises:

a roller-attached part to which the roller is attached;

a first end which protrudes from the roller-attached part in a direction perpendicular to the axis of the roller, and which comes in contact with the bottom end part of the plunger from below; and a second end which protrudes from the roller-attached part in a direction opposite to the first end, and which comes in contact with the lower end part of the pivot from below, wherein the second end has a concave part which is recessed downward, and in which the pivot is provided, and wherein the mounting member comprises:

a supporting part; and a pair of anti-turning parts, wherein before the plunger is brought into contact with the first end, the supporting part comes in contact with the arm body so as to resist a turn of the rocker arm around the roller under the weight of the rocker arm and keeps such an orientation of the rocker arm that the lower end part of the pivot is positioned within the concave part of the second end and that the outer circumferential surface of the lower end part of the pivot is apart from the inner circumferential surface of the concave part, wherein after the plunger is brought into contact with the first end, the supporting part comes out of contact with the arm body when the rocker arm turns reversely to the turn under the weight of the rocker arm, wherein the pair of anti-turning parts protrudes from the supporting part so that the arm body is sandwiched axially of the roller between the pair of anti-turning parts when the arm body comes in contact with the supporting part, and wherein the pair of anti-turning parts is formed to gradually increase in distance therebetween in a direction in which the pair of anti-turning parts protrudes.

2. A high-pressure pump to be installed in an internal-combustion engine having a cam shaft, comprising:

a rocker arm which is mounted on a cam provided on the cam shaft of the internal-combustion engine, and which rocks in association with a rotation of the cam;

a pivot which protrudes downward, and a lower end part of which supports the rocker arm in a rockable manner;

a plunger which reciprocates in a top-bottom direction in association with a movement of the rocker arm; and a mounting member which is fixed at a predetermined position, wherein the rocker arm comprises:

a roller which rotates on an axis parallel to the cam shaft, and which rolls on the outer circumferential surface of the cam; and an arm body which supports the roller in a rotatable manner, wherein the arm body comprises:

a roller-attached part to which the roller is attached;

a first end which protrudes from the roller-attached part in a direction perpendicular to the axis of the roller, and which comes in contact with the bottom end part of the plunger from below; and a second end which protrudes from the roller-attached part in a direction opposite to the first end, and which comes in contact with the lower end part of the pivot from below, wherein the second end has a concave part which is recessed downward, and in which the pivot is provided, and wherein the mounting member comprises:

a supporting part; and a pair of anti-turning parts, wherein before the plunger is brought into contact with the first end, the supporting part comes in contact with the arm body so as to resist a turn of the rocker arm around the roller under the weight of the rocker arm and keeps such an orientation of the rocker arm that the lower end part of the pivot is positioned within the concave part of the second end and that the outer circumferential surface of the lower end part of the pivot is apart from the inner circumferential surface of the concave part, wherein after the plunger is brought into contact with the first end, the supporting part comes out of contact with the arm body when the rocker arm turns reversely to the turn under the weight of the rocker arm, wherein the pair of anti-turning parts comprises:

a pair of vertical parts; and a pair of inclined parts, wherein the pair of vertical parts protrudes from the supporting part so that the arm body is sandwiched axially of the roller between the pair of vertical parts when the arm body comes in contact with the supporting part, wherein the pair of vertical parts is formed parallel to each other with a constant distance therebetween, and wherein the pair of inclined parts is continuous with the pair of vertical parts, and is formed to gradually increase in distance therebetween in a direction away from the pair of vertical parts.

* * * * *